US007806359B1

(12) United States Patent
Lillig

(10) Patent No.: US 7,806,359 B1
(45) Date of Patent: Oct. 5, 2010

(54) VEHICLE MOUNTED FENCE WIRE UNROLLING AND STRETCHING APPARATUS

(76) Inventor: James A. Lillig, 8703 E. 195th St., Belton, MO (US) 64012

( * ) Notice: Subject to any disclaimer, the term of this patent is extended or adjusted under 35 U.S.C. 154(b) by 45 days.

(21) Appl. No.: 12/175,284

(22) Filed: Jul. 17, 2008

(51) Int. Cl.
*B65H 16/02* (2006.01)

(52) U.S. Cl. ..... 242/557; 242/533.8; 242/403

(58) Field of Classification Search ..... 242/557, 242/533.8, 403; 140/107, 123.5; 256/37
See application file for complete search history.

(56) References Cited

U.S. PATENT DOCUMENTS

| | | | | |
|---|---|---|---|---|
| 404,536 | A | 6/1889 | Guthridge | |
| 695,351 | A | 3/1902 | Thompson | |
| 1,011,914 | A * | 12/1911 | Calhoun | 256/52 |
| 2,386,751 | A | 10/1945 | Sayles | |
| 2,789,778 | A | 4/1957 | Zogg et al. | |
| 2,896,877 | A | 7/1959 | Vaughn | |
| 2,914,270 | A | 11/1959 | Parker et al. | |
| 3,048,348 | A | 8/1962 | Griffin | |
| 4,775,114 | A | 10/1988 | Farnsworth | |
| 4,854,521 | A | 8/1989 | Farnsworth | |
| 5,158,243 | A | 10/1992 | Sigle et al. | |
| 5,163,634 | A | 11/1992 | Moon et al. | |
| 5,476,234 | A | 12/1995 | St. Pierre | |
| 5,568,900 | A | 10/1996 | Conroy | |
| 5,582,216 | A | 12/1996 | Smith et al. | |
| 5,806,779 | A | 9/1998 | Crum | |
| 6,042,046 | A | 3/2000 | Beyer, Sr. | |
| 6,302,156 | B1 | 10/2001 | Lardet et al. | |
| 6,360,984 | B1 | 3/2002 | England | |

* cited by examiner

*Primary Examiner*—Sang Kim
(74) *Attorney, Agent, or Firm*—Erickson, Kernell, Derusseau & Kleypas, LLC

(57) ABSTRACT

A fence wire unrolling and stretching apparatus includes a base, a spindle extending upwardly from the base, and a hitch member extending outwardly from the base in approximately perpendicular relation to the spindle. The hitch member is sized and shaped to be receivable within a receiver hitch of a vehicle, such as a pickup truck. The spindle has a plurality of transverse holes formed therethrough, each hole being at a height above the base selected to correspond to a height of a roll of a respective type of fence wire. A lock bar comprising a shaft and a flange connected to the shaft along a portion of its length is receivable through any one of the holes in the spindle. The flange has an edge which is engageable with an end of a roll of fence wire positioned on the spindle to prevent the roll from rotating.

23 Claims, 5 Drawing Sheets

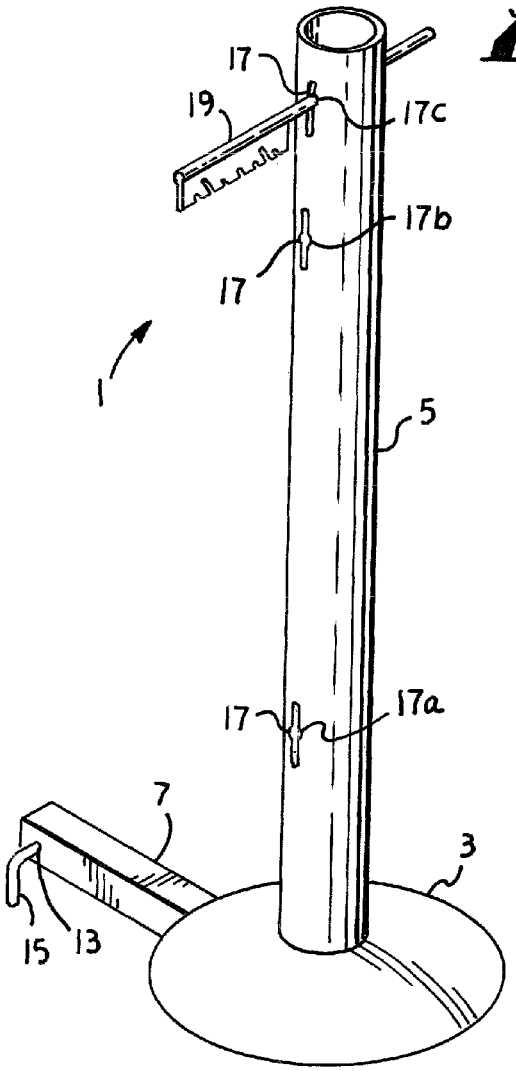
Fig. 1.
Fig. 2.
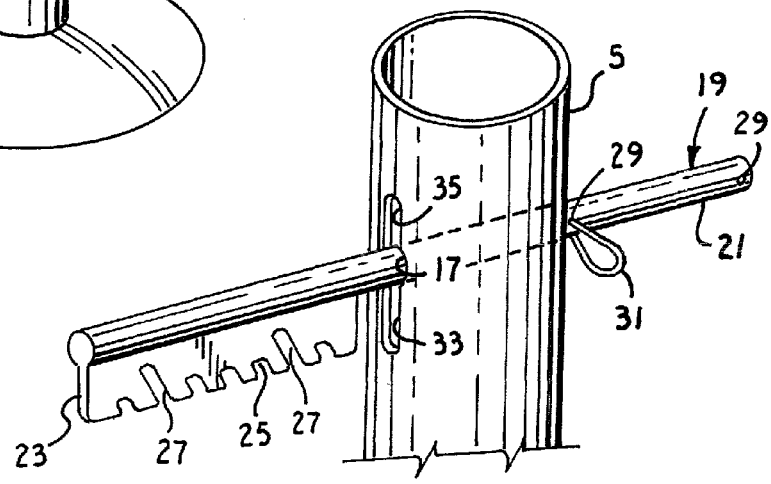

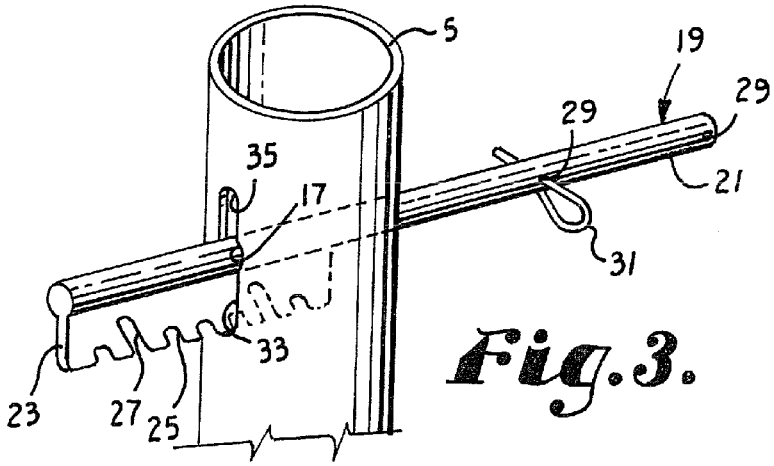
Fig. 3.
Fig. 4.
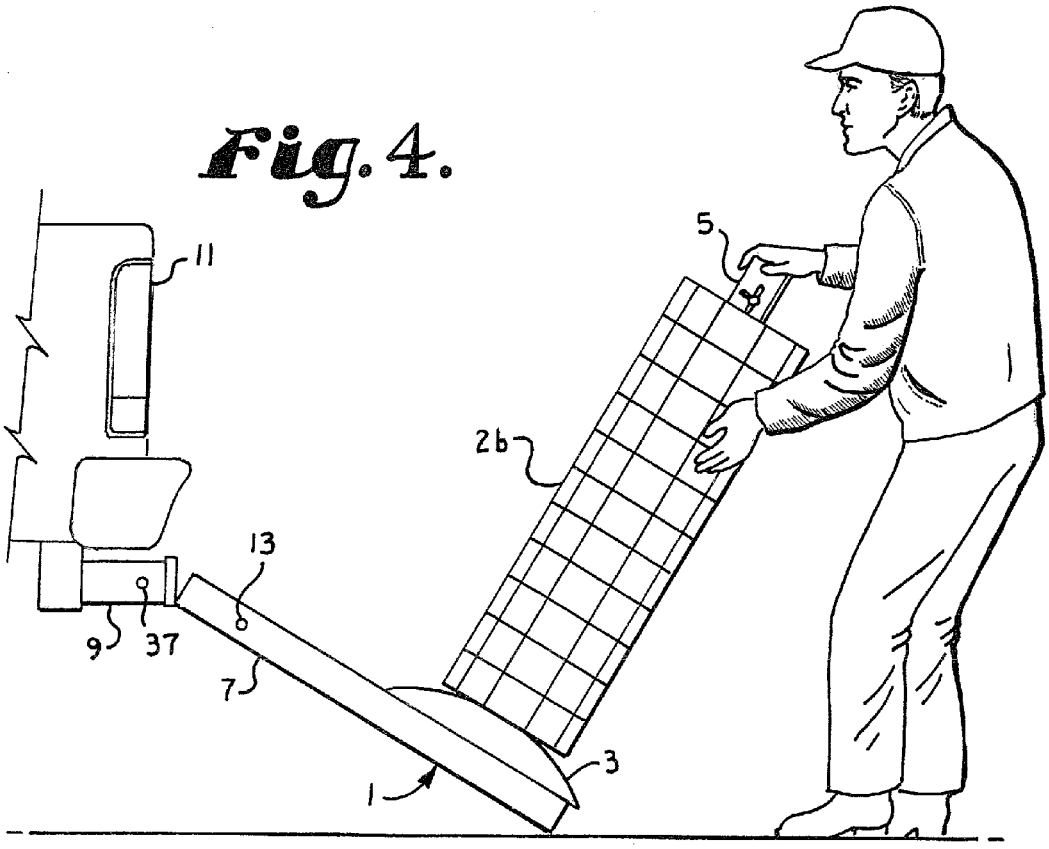

VEHICLE MOUNTED FENCE WIRE UNROLLING AND STRETCHING APPARATUS

BACKGROUND OF THE INVENTION

1. Field of the Invention

The present invention relates to the field of tools for fence building, and in particular to a vehicle mounted apparatus for unrolling and stretching fence wire.

2. Description of the Related Art

The building of farm fences can be an extremely laborious and time consuming task. First, the fence posts are generally set at regular intervals along the planned fence line. At each end of the fence is a corner post which is preferably cross-braced to resist tension in the fence wire. The posts between the corner posts are generally referred to as line posts.

After the posts are set, the fence wire must be rolled out, tensioned, and attached to the posts. Wire used in farm fences is typically either barbed wire or woven wire (which is available in various heights including 26 inch, 32 inch, 39 inch, 47 inch, 49 inch and 55 inch heights). An end of a roll of wire is first connected to one of the corner posts, and the wire is then unrolled along the length of the fence. After the wire is unrolled, it must be tensioned or "stretched" so that the fence wire is tight. The wire is then tied off to the second corner post and secured to each of the line posts.

The step of unrolling fence wire is made difficult by the weight of the rolls of wire. A standard quarter mile (1320 foot) roll of 12½ gauge barbed wire may weigh in the neighborhood of 85 pounds. Woven fence wire is even more difficult to manage because a standard 330 foot roll of 47 inch woven wire may weigh 200-300 pounds depending upon the wire gauge.

Rolls of fence wire have generally been unrolled manually by either rolling the roll of wire along the ground, or by inserting a bar through the center of the roll and carrying the roll of wire by the bar such that the bar becomes an axle about which the roll rotates. Each of these methods has its disadvantages. When attempting to roll a roll of wire along the ground, debris such as grass and sticks can become entangled in the wire and prevent it from unrolling easily. In addition, the roll may become snagged upon rocks or stumps, fall into ruts, or be otherwise be made difficult to roll by uneven ground.

One person may sometimes manage a roll of barbed wire on an axle by grasping an end of the axle in each hand, however the person often finds that his shirt quickly becomes snagged by the barbs. Two people can manage a roll of barbed wire more easily, however a second person is not always available. Even two people will find it difficult to manage a 200-300 pound roll of woven wire in this manner.

After the wire is rolled out, the tensioning operation is typically accomplished manually using a small hand winch, block and tackle, or lever operated wire stretching device.

Previous vehicle-mounted devices have been designed to unroll and stretch fence wire, however these devices have generally been designed to mount on a three-point hitch of a farm tractor. Examples of such devices are shown in U.S. Pat. No. 2,914,270 to Parker, et al.; U.S. Pat. No. 3,048,348 to Griffin; and U.S. Pat. No. 5,163,634 to Moon et al. These devices all suffer from being relatively large, heavy, complex pieces of equipment. In addition, these devices require the use of a tractor, which is not always readily available.

What is needed is a simple, lightweight device for unrolling and tensioning fence wire which is mountable on a light utility vehicle such as a pickup truck.

SUMMARY OF THE INVENTION

The present invention comprises a fence wire unrolling and stretching apparatus including a base, a spindle extending upwardly from the base for rotatably receiving a roll of fence wire, and a hitch member extending outwardly from the base in approximately perpendicular relation to the spindle, the hitch member being sized and shaped to be receivable within a receiver hitch of a vehicle. The apparatus also includes means for selectively locking a roll of fence wire positioned on the spindle to prevent rotational movement of the wire about the spindle so that the wire may be stretched by advancing the vehicle.

The locking means may comprise a transverse hole formed through the spindle and a lock bar having a round shaft and a flange connected to the shaft along a portion of its length. The shaft is receivable through the hole in the spindle such that an edge of the flange is engageable with an end of the roll of fence wire when the roll of fence wire is positioned on the spindle. As the vehicle moves forward, the flange wedges against the fence wire and prevents rotation of the roll. The apparatus preferably includes a plurality of holes in the spindle positioned at heights above the base selected to correspond to the heights of rolls of various types of fence wire.

Each of the holes in the spindle may include a downwardly extending slot sized to receive a portion of the longitudinal flange of the lock bar. The slots are used to retain the lock bar in a position wherein the flange extends fully downwardly. This is particularly useful when stretching a roll of wire which has become "spongy" because only a relatively few coils of wire remain on the roll. Under these circumstances the lock bar may not effectively wedge the roll of wire in position if it is left to pivot freely.

BRIEF DESCRIPTION OF THE DRAWINGS

FIG. 1 is a perspective view of a wire unrolling and stretching apparatus embodying the present invention.

FIG. 2 is an enlarged, fragmentary perspective view of the apparatus of FIG. 1 showing the lock bar of the apparatus disengaged from slots in the spindle of the apparatus.

FIG. 3 is a view similar to FIG. 2 showing the lock bar engaged with a slot in the spindle.

FIG. 4 is a side view of the apparatus showing how it is installed onto a vehicle.

DETAILED DESCRIPTION OF THE PREFERRED EMBODIMENTS

Figure 5:
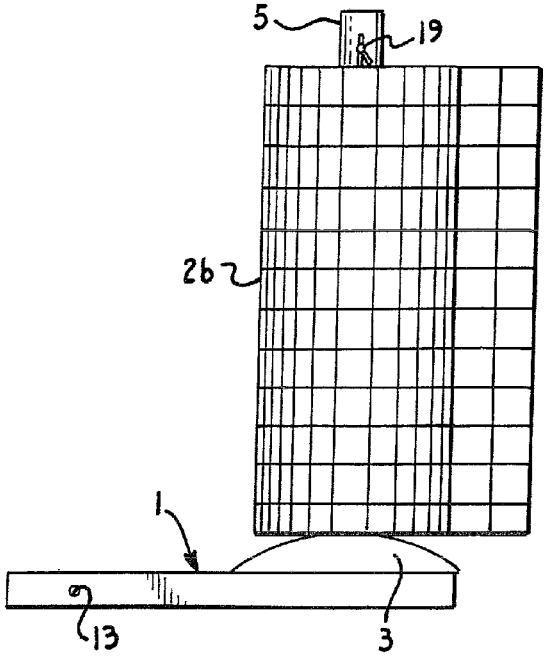
FIG. 5 is a side view of the apparatus showing a preferred method of stretching woven wire.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a fence wire unrolling and stretching apparatus embodying the present invention. The apparatus 1 is mountable on a motor vehicle, such as a pickup truck or other utility vehicle, and used to unroll a roll of fence wire 2, such as a roll of barbed wire 2*a* or a roll of woven wire 2*b* during the construction of a fence. After the wire 2 is unrolled, the wire 2 may be locked to the apparatus 1 so that the wire may be stretched or tensioned by simply pulling the vehicle forward.

Referring to FIG. 1, the apparatus 1 includes a base 3 which is shown as comprising a round, upwardly convex disk of the type used as soil-working tools on agricultural implements. Fixedly attached to the base 3 proximate its center and extending upwardly therefrom is a spindle 5 which is sized to fit through the respective center hole of each roll of wire to be unrolled and stretched using the apparatus 1. For example, the spindle 5 may be formed of 3.25 inch OD tubing. The length or height of the spindle 5 is determined by the height of the rolls of wire to be used on the apparatus 1. A length of approximately 60 inches should be sufficient to handle up to 49 inch woven wire.

Attached to the underside of the base 3 and extending outwardly from the base 3 in generally perpendicular orientation to the spindle 5 is a hitch member 7 formed of square tubing (such as 2 inch square tubing) sized to be receivable within a receiver hitch 9 of a vehicle 11, such as a pickup truck or other utility vehicle (See FIG. 4). For purposes of structural strength, the spindle 5 preferably passes through the base 3 and is rigidly secured, such as by welding, to the hitch member 7. A hole 13 is formed through the hitch member 7 for receiving a pin 15 which secures the apparatus 1 to the receiver hitch 9.

Formed through the spindle 5 is at least one transverse hole 17. If the spindle 5 is tubular, each hole 17 will pass completely through the tubular spindle 5 and, therefore, pierce the wall of the tube twice. Three holes 17, designated 17*a*, 17*b* and 17*c* are shown. The center of each hole 17 is spaced along the spindle 5 to correspond to the height of a roll of a respective type of fence wire such that the hole 17 is spaced somewhat above the top of the respective roll of wire when the wire is placed over the spindle 5. For example, hole 17*a* may be spaced approximately 11 inches above the base 3 to correspond to a 10 inch roll of barbed wire 2*a*, hole 17*b* may be spaced approximately 33 inches above the base 3 to correspond to a roll of 32 inch woven wire 2*b*, and hole 17*c* may be spaced approximately 48 inches above the base 3 to correspond to a roll of 47 inch woven wire 2*b*.

Also forming a part of the apparatus 1 is a lock bar 19 which is best seen in FIGS. 2 and 3. The lock bar 19 includes a shaft 21 sized to be receivable through any of the transverse holes 17*a*-17*c* in the spindle 5. Fixedly attached to the shaft 21 along a portion of its length is a longitudinal flange 23. The flange 23 has an exposed longitudinal edge 25 which is preferably serrated to better grip a roll of wire 2. The distance from the edge 25 of the flange 23 to the center of the shaft 21 should be somewhat greater than the distance between the top of a roll of wire 2 positioned on the spindle 5 and the center of the respective hole 17. For example, the distance between the edge 25 and the center of the shaft 21 may be 1.5 inches for an apparatus wherein the centers of the holes 17 are 1 inch above the tops or the respective rolls of wire 2.

At least one generally transverse notch 27 (two shown) is formed in the flange 23 and sized to be large enough to receive a strand of barbed wire 2*a* but small enough to prevent a barb on the strand of barbed wire 2*a* from passing therethrough. The lock bar 19 further includes at least one receiver 29 passing through the shaft 21 which receives a hairpin 31 to retain the lock bar 19 in a respective hole 17.

Each hole 17 includes a respective downwardly extending slot 33 sized to receive a portion of the flange 23 of the lock bar 19 so as to prevent the lock bar 19 from turning in the hole 17. The slots 33 need not extend entirely through the spindle 5, therefore if the spindle 5 is tubular, the slots 33 need only pierce the wall of the tube once. Similarly each hole 17 may also include a respective upwardly extending slot 35 which is also sized to receive a portion of the flange 23 of the lock bar 19. The flange 23 is shown inserted in the slot 33 in FIG. 3.

In use, a roll of wire 2, which may be either a roll of barbed wire 2*a* or a roll of woven wire 2*b*, is placed on the spindle 5 of the apparatus 1. The apparatus 1 may then be attached to the vehicle 11 by placing the distal end of the hitch member 7 into contact with the receiver hitch 9, as shown in FIG. 4, while the weight of the apparatus 1 and wire 2 rests on the side of the base 3 opposite the hitch member 7. The apparatus 1 can then be levered into engagement with the hitch 9 by pushing against the spindle 5 (or roll of wire 2) and lifting the apparatus 1 into place. The pin 15 is then installed through hole 13 in the hitch member 7 and a matching hole 37 in the receiver hitch 9 to secure the apparatus 1 to the receiver hitch 9.

Alternatively, it would also be possible to build the apparatus 1 with a hinge joint (not shown) in the hitch member 7 such that the hitch member 7 could be connected to the receiver hitch 9 before the spindle 7 is lifted into a generally vertical orientation. The hinge joint could then be locked into position or would automatically lock when the desired position is reached.

A free end of the wire 2 is secured to a corner post, tree, or similar rigid structure in the fashion routinely used in fence building. The vehicle 11 can then be driven along the planned fence line, unrolling the wire 2 behind it. As the wire 2 unrolls, the roll of wire 2 rotates around the spindle 5 on the base 3. The base 5 thus acts as a bearing surface for the roll of wire 2. If the base 3 has the preferred upwardly convex shape shown herein, the outer portions of the roll of wire 2 do not contact the base 3 and resistance to rotation is reduced. During the unrolling process, the lock bar 19 is not used.

Figure 6:
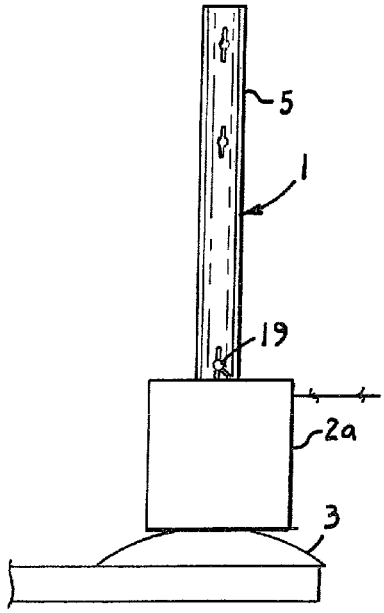
FIG. 6 is a side view of the apparatus showing a preferred method of stretching barbed wire.

Once a desired length of wire 2 has been unrolled, the lock bar 19 is installed in the hole 17 adjacent the top of the roll of wire 2, as shown in FIGS. 5 and 6. Under most conditions, the flange 23 of the lock bar 19 is not pushed into the respective slot 33 or 35 in the spindle 5; instead the serrated edge 25 of the flange 23 is allowed to pivot into contact with the top of the roll of wire 2. The vehicle 11 is then pulled forward again. With the lock bar 19 in place, the flange 23 will engage the top of the roll of wire 2 and wedge itself against the roll of wire 2 to prevent the roll of wire from turning about the spindle 5, and no further wire 2 will unroll. The wire 2 can thus be stretched by pulling the vehicle 11 forward until the wire 2 reaches a desired tension. Once the wire is stretched, it can be attached to the fence posts in the usual fashion.

Alternative Stretching Methods

Figure 7:
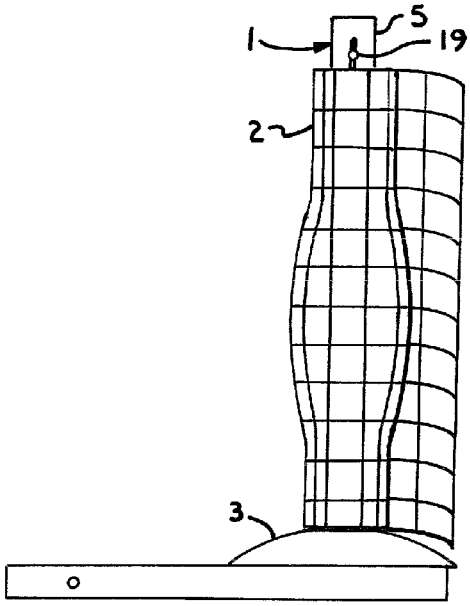
FIG. 7 is a side view of the apparatus showing an alternative method of stretching wire applicable when the roll of wire is mostly depleted.

Referring to FIG. 7, when a roll of wire 2 (which may be either a roll of barbed wire 2*a* or a roll of woven wire 2*b*) is reduced to a relatively few coils of wire, the roll will become easily compressible or "spongy" in the vertical direction. Under these circumstances, the edge 25 of the lock bar flange 23 will not effectively engage the roll of wire to prevent the roll of wire 2 from turning if the lock bar 19 is allowed to pivot freely. In order to force the edge 25 into positive engagement with the roll of wire 2, the lock bar 19 may be pivoted downwardly until the flange 23 is aligned with the downwardly extending slot 33 in the spindle 5. The lock bar 19 is then pushed inwardly toward the spindle 5 until the flange 23 is received within the slot 33. With the flange 23 thus engaged with the slot 33, the lock bar 19 is prevented from pivoting, and the maximum amount of downward pressure is continuously exerted on the roll of wire 2.

The apparatus 1 provides still other means for stretching wire 2 which are particularly useful when stretching barbed wire 2*a*. These methods generally involve using the notch 27 formed in the lock bar flange 23 to engage the wire 2*a* so that it may be stretched. These methods are somewhat less desirable than the preferred methods discussed above because only a single strand of wire 2*a* is engaged by the lock bar 19, instead of an edge of the roll of wire 2*a*, however these methods may have advantages under certain fence building conditions.

Figure 8:
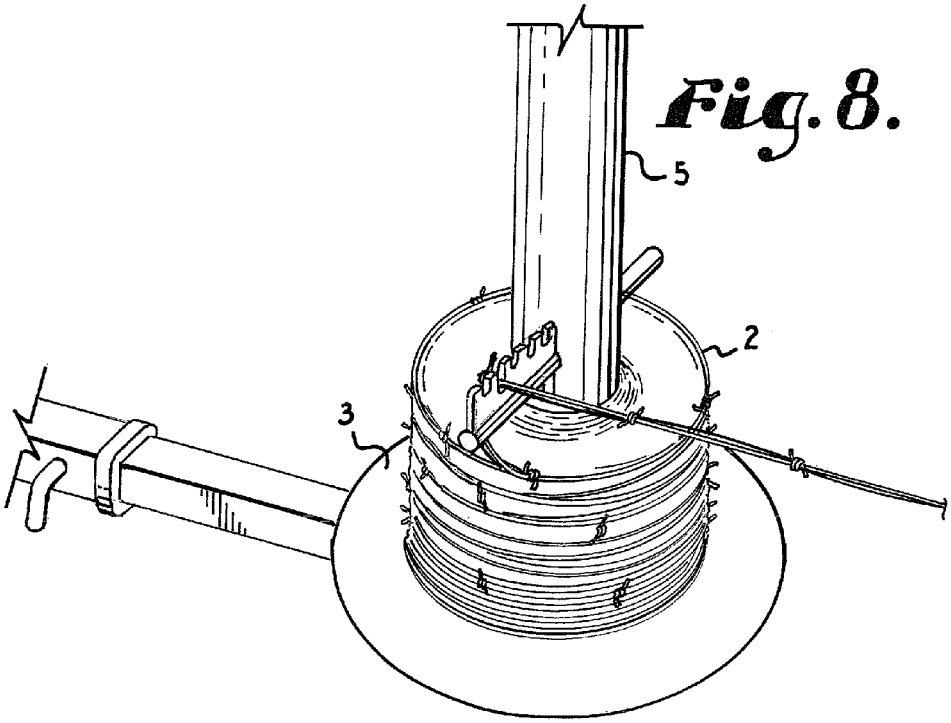
FIG. 8 is a side view of the apparatus showing a first alternative method of stretching barbed wire.

In one such method (shown in FIG. 8) the roll of wire 2*a* rests on the base 3 as previously described. The lock bar 19 is inserted through one of the holes 17 with the flange 23 pointed upwardly, and the flange 23 is inserted into the upwardly extending slot 35. The wire 2*a* is routed through the notch 27 in the lock bar flange 23. As the vehicle 11 is pulled forwardly, a barb of the wire 2*a* will engage the edges of the notch 27 and prevent the wire 2*a* from pulling further through the notch 27. Continued forward movement of the vehicle 11 will then stretch the wire 2*a*. Care must be taken when stretching the wire 2 to prevent snapping the wire.

Figure 9:
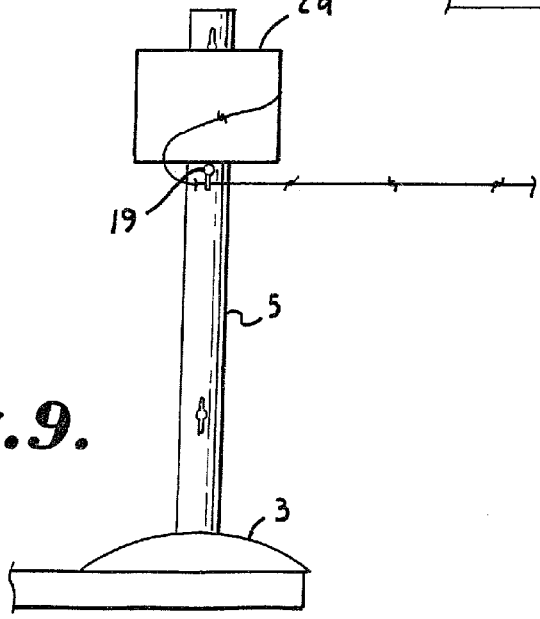
FIG. 9 is a side view of the apparatus showing a second alternative method of stretching barbed wire.

When building a barbed wire fence, particularly when stringing the upper strands of wire 2*a*, it may be desirable to elevate the roll of wire 2*a* above the base 3. One way to do this, as shown in FIG. 9, is to insert the lock bar 19 into one of the holes 17 with the flange 23 engaging the respective downwardly extending slot 33 in the spindle 5, and to then place the roll of wire 2*a* on top of the lock bar 19. The wire 2*a* is then looped under the lock bar 19 and through the notch 27 in the lock bar flange 23. As the vehicle 11 is pulled forwardly, a barb of the wire 2*a* will engage the edges of the notch 27 and prevent the wire 2*a* from pulling further through the notch 27. Continued forward movement of the vehicle 11 will then stretch the wire 2*a*.

Alternative Embodiment

Figure 10:
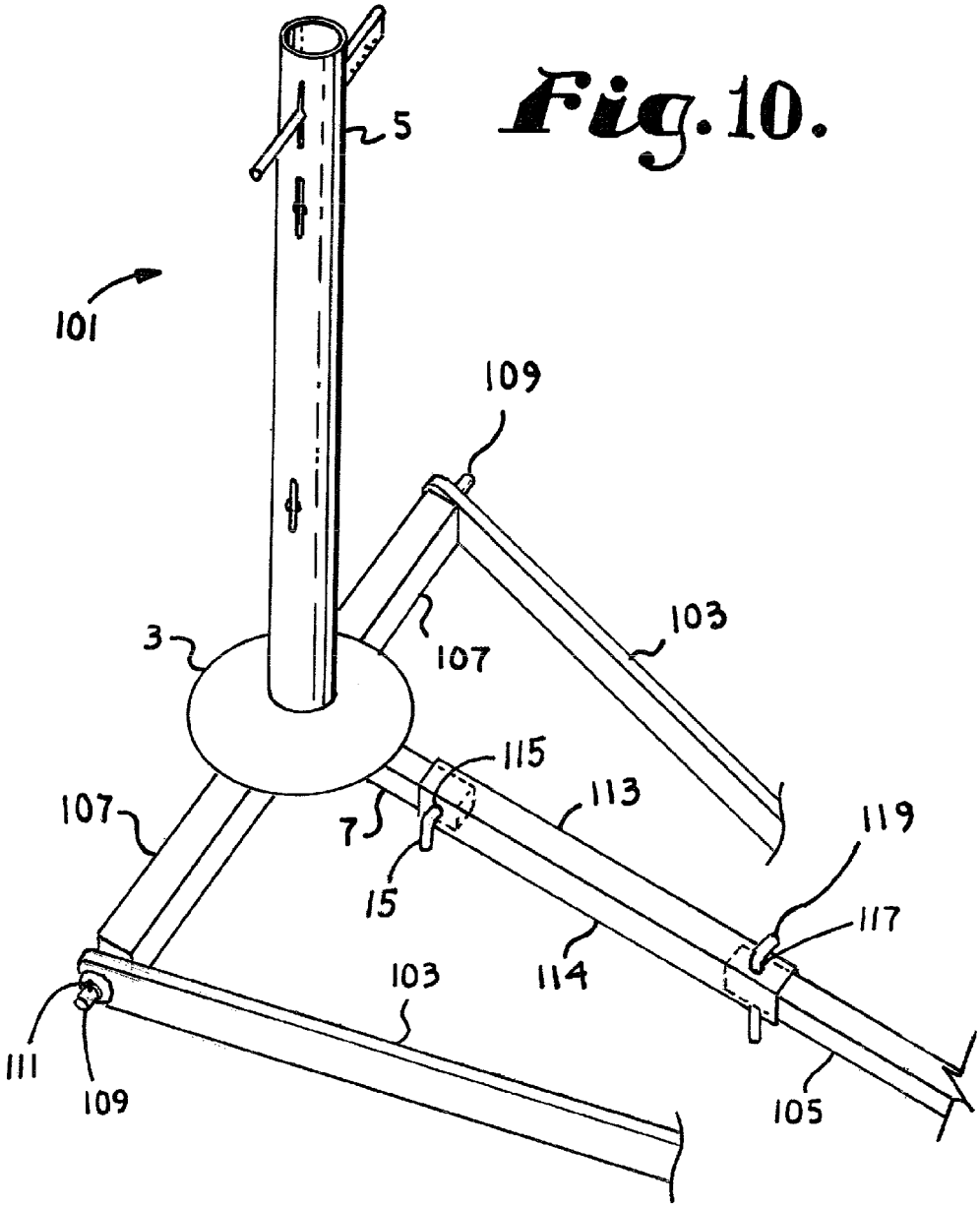
FIG. 10 is a perspective view of an alternative embodiment of the apparatus.

An alternative embodiment 101 of the wire unrolling and stretching apparatus is shown in FIG. 10. The apparatus 101 is generally identical to the apparatus 1 except that it includes means for mounting the apparatus 101 on a farm tractor (not shown) having a three-point hitch with lower links 103 and a drawbar 105, in addition to being mountable on a receiver hitch of a utility vehicle.

Extending outwardly from each side of the apparatus 101 in generally perpendicular relation to the hitch member 7 are a pair of aims 107, each of which terminates in a respective lift arm pin 109. Each arm 107 is preferably welded to both the hitch member 7 and the base 3. The lift arm pins 109 are receivable within receivers in the lower links 103 of the tractor three-point hitch and are securable to the lower links 103 with lynch pins 111 as is commonplace with tractor mounted machinery.

A drawbar extension 113, such as an extension tube 114 is used to connect the hitch member 7 of the apparatus 101 to the tractor drawbar 105. The extension tube 114 is shown as being of square cross-section so as to be slidably receivable over both the hitch member 7 and the tractor drawbar 105. A pair of aligned holes 115 are formed through the extension tube 114 proximate one end thereof and are sized to receive the pin 11/5 which secures the extension tube 114 to the hitch member 7. A second pair of holes 117 are formed proximate the opposite end of the tube 114 for receiving a hitch pin 119 which secures the extension tube 114 to the tractor drawbar 105.

It should be noted that some tractors have drawbars 105 which may be extended outwardly far enough from the tractor that no drawbar extension 113 is required. It should also be noted that drawbar extensions 113 other than the extension tube 114 can be used when such an extension is required. For example, the drawbar extension 113 could comprise a bar with a clevis on each end (not shown).

It is to be understood that while certain fauns of the present invention have been illustrated and described herein, it is not to be limited to the specific forms or arrangement of parts described and shown. It is also to be understood that the stretching methods described herein are not intended to be exclusive and that other stretching methods may be accomplished using the apparatus 1. It is also to be understood that several of the methods described above can possibly be combined to stretch more than one wire 2 at a time.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A fence wire unrolling and stretching apparatus comprising:

a. a base;

b. a spindle extending upwardly from said base, said spindle having a transverse hole formed therethrough at a height above said base selected to correspond to a height of a first roll of fence wire;

c. a hitch member extending outwardly from said base in approximately perpendicular relation to said spindle, said hitch member being sized and shaped to be receivable within a receiver hitch of a vehicle; and d. a lock bar comprising a round shaft and a radially extending longitudinal flange connected to said shaft along a portion of the length thereof, said shaft being receivable through said transverse hole in said spindle, said longitudinal flange having an edge moveable into engagement with an end of the first roll of fence wire when said lock bar is received through said transverse hole and the first roll of fence wire is positioned on said spindle to prevent the first roll of wire from rotating about said spindle.

2. The fence wire unrolling apparatus as in claim 1 and further including a pair of arms extending outwardly from said base in opposed lateral directions, each said arm terminating in a respective lift arm pin sized to be engageable with a lower link of a tractor three-point hitch.

3. The fence wire unrolling apparatus as in claim 2 and further including a drawbar extension for connecting said hitch member to a tractor drawbar.

4. The fence wire unrolling and stretching apparatus as in claim 1 wherein said transverse hole in said spindle includes a downwardly extending slot sized to receive a portion of said longitudinal flange of said lock bar and thereby prevent said lock bar from rotating in said transverse hole and retain said longitudinal flange in a downwardly extending orientation.

5. The fence wire unrolling and stretching apparatus as in claim 4 wherein said transverse hole in said spindle further includes an upwardly extending slot sized to receive a portion of said longitudinal flange of said lock bar and thereby prevent said lock bar from rotating in said transverse hole and retain said longitudinal flange in an upwardly extending orientation.

6. The fence wire unrolling and stretching apparatus as in claim 1 wherein said transverse hole in said spindle is a first transverse hole and said apparatus further includes a second transverse hole formed through said spindle at a height above said base selected to correspond to a height of a second roll of fence wire having a different height from said first roll of fence wire.

7. The fence wire unrolling and stretching apparatus as in claim 6 wherein said first transverse hole is at a height selected to correspond to a height of a roll of barbed wire and said second transverse hole is at a height selected to correspond to a height of a roll of woven wire.

8. The fence wire unrolling and stretching apparatus as in claim 6 wherein each said transverse hole in said spindle includes a respective downwardly extending slot sized to receive a portion of said longitudinal flange of said lock bar and thereby prevent said lock bar from rotating in the respective transverse hole and retain said longitudinal flange in a downwardly extending orientation.

9. The fence wire unrolling and stretching apparatus as in claim 6 wherein each said transverse hole in said spindle further includes a respective upwardly extending slot sized to receive a portion of said longitudinal flange of said lock bar and thereby prevent said lock bar from rotating in the respective transverse hole and retain said longitudinal flange in an upwardly extending orientation.

10. The fence wire unrolling and stretching apparatus as in claim 1 wherein said base is circular and upwardly convex.

11. The fence wire unrolling and stretching apparatus as in claim 1 wherein said edge of said longitudinal flange of said lock bar is serrated.

12. The fence wire unrolling and stretching apparatus as in claim 1 wherein said longitudinal flange of said lock bar includes a notch sized to receive a strand of barbed wire but smaller than barbs on the strand of barbed wire such that the barbs are prevented from passing therethrough.

13. A fence wire unrolling and stretching apparatus comprising:

a. a base;

b. a spindle extending upwardly from said base, said spindle having a plurality of transverse holes formed therethrough, each said transverse hole being at a height above said base selected to correspond to a height of a roll of a respective type of fence wire;

c. a hitch member extending outwardly from said base in approximately perpendicular relation to said spindle, said hitch member being sized and shaped to be receivable within a receiver hitch of a vehicle; and d. a lock bar comprising a round shaft and a radially extending longitudinal flange connected to said shaft along a portion of the length thereof, said shaft being receivable through any one of said transverse holes in said spindle, said longitudinal flange having an edge moveable into engagement with an end of a roll of the respective type of fence wire when said lock bar is received through one of said transverse holes and the respective roll is positioned on said spindle to prevent the roll of wire from rotating about said spindle.

14. The fence wire unrolling and stretching apparatus as in claim 13 wherein each said transverse hole in said spindle includes a respective downwardly extending slot sized to receive a portion of said longitudinal flange of said lock bar and thereby prevent said lock bar from rotating in said transverse hole and retain said longitudinal flange in a downwardly extending orientation.

15. The fence wire unrolling and stretching apparatus as in claim 14 wherein each said transverse hole in said spindle further includes a respective upwardly extending slot sized to receive a portion of said longitudinal flange of said lock bar and thereby prevent said lock bar from rotating in said transverse hole and retain said longitudinal flange in an upwardly extending orientation.

16. The fence wire unrolling and stretching apparatus as in claim 14 and further including a drawbar extension for connecting said hitch member to a tractor drawbar.

17. The fence wire unrolling and stretching apparatus as in claim 13 wherein said longitudinal flange of said lock bar includes a notch sized to receive a strand of barbed wire but smaller than barbs on the strand of barbed wire such that the barbs are prevented from passing therethrough.

18. The fence wire unrolling and stretching apparatus as in claim 13 and further including a pair of arms extending outwardly from said base in opposed lateral directions, each said arm terminating in a respective lift arm pin sized to be engageable with a lower link of a tractor three-point hitch.

19. A fence wire unrolling and stretching apparatus comprising:

a. a base;

b. a spindle extending upwardly from said base, said spindle having a plurality of transverse holes formed therethrough, each said transverse hole being at a height above said base selected to correspond to a height of a roll of a respective type of fence wire;

c. a lock bar comprising a round shaft and a radially extending longitudinal flange connected to said shaft along a portion of the length thereof, said shaft being receivable through any one of said transverse holes in said spindle, said longitudinal flange having an edge moveable into engagement with an end of a roll of the respective type of fence wire when said lock bar is received through one of said transverse holes and the respective roll is positioned on said spindle to prevent the roll of wire from rotating about said spindle; and d. means for mounting said apparatus to a vehicle.

20. The fence wire unrolling and stretching apparatus as in claim 19, wherein the vehicle to which said apparatus is mountable is a utility vehicle having a receiver hitch, and said means for mounting comprises a hitch member extending outwardly from said base in approximately perpendicular relation to said spindle, said hitch member being sized and shaped to be receivable within the receiver hitch.

21. The fence wire unrolling and stretching apparatus as in claim 19, wherein the vehicle to which said apparatus is mountable is a tractor having a three-point hitch and a drawbar, and said means for mounting comprises:

a. a pair of arms extending outwardly from said base in opposed lateral directions, each said arm terminating in a respective lift arm pin sized to be engageable with a lower link of the three-point hitch; and b. means for connecting said base to the drawbar.

22. The fence wire unrolling and stretching apparatus as in claim 21, wherein said means for connecting comprises a hitch member extending outwardly from said base in approximately perpendicular relation to said spindle.

23. The fence wire unrolling and stretching apparatus as in claim 21, wherein said means for connecting comprises:

a. a hitch member extending outwardly from said base in approximately perpendicular relation to said spindle; and b. a drawbar extension for connecting said hitch member to the tractor drawbar.

* * * * *